US007251953B2

(12) United States Patent
Wetzel et al.

(10) Patent No.: US 7,251,953 B2
(45) Date of Patent: Aug. 7, 2007

(54) ENVIRONMENTAL CONTROL UNIT FOR HOSPITAL ROOM

(75) Inventors: Michael L. Wetzel, Skaneateles, NY (US); Lawrence E. Wetzel, Cazenovia, NY (US)

(73) Assignee: Air Innovations, Inc., North Syracuse, NY (US)

( * ) Notice: Subject to any disclaimer, the term of this patent is extended or adjusted under 35 U.S.C. 154(b) by 152 days.

(21) Appl. No.: 11/188,188

(22) Filed: Jul. 22, 2005

(65) Prior Publication Data

US 2006/0021375 A1 Feb. 2, 2006

Related U.S. Application Data

(60) Provisional application No. 60/591,135, filed on Jul. 27, 2004.

(51) Int. Cl.
*F25D 17/06* (2006.01)

(52) U.S. Cl. ..... 62/419; 454/233; 454/236

(58) Field of Classification Search ..... 62/186, 62/298, 410, 411, 412, 419, 426; 454/233, 454/236

See application file for complete search history.

(56) References Cited

U.S. PATENT DOCUMENTS 4,835,983 A * 6/1989 Chandler et al. ..... 62/259.1
5,004,483 A * 4/1991 Eller et al. ..... 95/10
5,239,834 A * 8/1993 Travers ..... 62/151
5,987,908 A * 11/1999 Wetzel ..... 62/259.1
6,619,063 B1 * 9/2003 Brumett ..... 62/264
6,796,896 B2 * 9/2004 Laiti ..... 454/229
6,895,774 B1 * 5/2005 Ares et al. ..... 62/332
2003/0177777 A1 * 9/2003 Brumett ..... 62/264

FOREIGN PATENT DOCUMENTS

JP 2002-136229 A * 5/2002

* cited by examiner

*Primary Examiner*—Mohammad M. Ali
(74) *Attorney, Agent, or Firm*—Bernhard O. Molldrem, Jr.

(57) ABSTRACT

An air conditioner and filtering unit produces a positive or negative pressure to create an isolation space. A common air intake plenum has first and second inlets for admitting return air from the space or outside air which may be from a building main A/C system supply. Sanitized, cleaned and conditioned air is returned to the conditioned space; and condenser air is exhausted outside the conditioned space. The air intake plenum may be common to both the condenser air flow and to the evaporator air flow. A HEPA filter cleans the air suppled to both the condenser and the evaporator. A slide damper or other arrangement selectively opens and closes air flow through the first and second air inlets into the common intake plenum. This permits creation of overpressure, underpressure, or an intermediate pressure in the conditioned space. All air supplied to the room and all air exhausted from the room is cleaned and sanitized. The unit is self-contained and portable.

10 Claims, 9 Drawing Sheets

ENVIRONMENTAL CONTROL UNIT FOR HOSPITAL ROOM

Priority is claimed of U.S. Provisional Application No. 60/591,135, filed Jul. 27, 2004, the disclosure of which is incorporated by reference.

BACKGROUND OF THE INVENTION

The invention concerns room air conditioning and filtration equipment, and in particular is directed to a unit that can operated in a positive pressure mode, a negative pressure mode, or a normal mode. The invention is also concerned with units that clean and condition the room air as well as remove or kill airborne pathogens, and which have a mechanism for introducing make-up air to create a positive pressure or overpressure in the room relative to the outside ambient air, or exhausting some of room air to create a negative pressure relative to the outside air. At least one of the inventors is the patentee of U.S. Pat. No. 5,884,500, Mar. 23, 1999 and U.S. Pat. No. 5,987,908, Nov. 23, 1999, which are incorporated herein by reference.

High Efficiency Particulate Air (HEPA) filters are used extensively in industrial, commercial and residential applications to filter out dust and dirt from the air which can harbor harmful bacteria or other micro-organisms. These filters are capable of filtering out more than 99.99% of the particles in the air.

Recently, due to the occurrence of terrorist strikes and outbreaks of contagious diseases such as SARS, there has been a heightened concern about contaminants in the indoor air, and about the ability to exclude or confine contaminants in a given area. Also, medical services are required in sufficient capacity and of the appropriate quality to handle extraordinary events or circumstances. Each community needs to have a surge capacity plan for handling a large number of emergency patients. If a terrorist event or outbreak of disease occurs, it will become necessary to isolate at least some of the patients. Some patients will need to be isolated in a fashion to keep any airborne contaminants within a confined area to protect others from the contagion. Other patients, e.g., burn patients, will need to be protected from outside contaminants reaching the patient area. Hospitals today lack sufficient numbers of hospital rooms that can be used for isolation of patients, whereas the need to isolate patients from the general public or from one another is critical in controlling the situation, whether the patients are in surge capacity facilities or in traditional hospitals.

Most hospitals today have only a few isolation rooms out of the hundreds of patient rooms in the facility. One reason for this is because isolation rooms are very expensive to build because they conventionally require separate, independent HVAC systems for each room to prevent the spread of contaminants to other areas of the hospital. In those cases where the patient is susceptible to contaminants, the room must operate at a positive pressure, whereas when the patient is infected with a contagious pathogen, the room must be under a negative pressure to protect other patients and hospital workers. However, even with isolation HVAC systems the rooms are not easy to convert from positive pressure to negative pressure or vice versa. These rooms are generally built either for positive pressure only or for negative pressure only, and this limits the flexibility of a hospital to deal with emergency situations.

Other applications could include laboratories within a hostile environment that may need a positive pressure, e.g., in a paper mill. Other examples include museum archiving rooms that need a positive pressure.

The inventor herein proposes to convert a room air conditioning unit, similar in some ways to the type described in the above-mentioned U.S. Pat. Nos. 5,884,500 and 5,987,908 to be suited for use in converting a standard, typical hospital room to an isolation room, and which can be provided with neutral pressure (equaling outside air pressure), a negative pressure relative to outside air pressure, or a positive pressure relative to outside air pressure.

These units, known commercially as HEPAir units, are used extensively in clean room situations to control airborne contaminants while maintaining temperature and humidity control for critical processes such as the sterile packaging of medical devices or pharmaceuticals. These units are also used extensively in the manufacture of semiconductor devices. These are not simple portable air conditioning units, but are industrial in nature and capable of handling relatively large volumes of air against a high static pressure such as that encountered with high efficiency particulate air (HEPA) filters, and are capable of attaining an air exchange rate that is sufficient to assure dilution and purge.

OBJECTS AND SUMMARY OF THE INVENTION

It is an object to provide a unit for cleaning and conditioning of air in a room that can be easily installed in an existing room to create an isolation space having net positive pressure or net negative pressure, as needed, and which avoids the drawbacks of the prior art.

It is another object to provide a unit to convert an existing room to an isolation room, in which the air exiting the unit into the room and any air exhausted from the unit to outside the room is sanitized, filtered, and cleaned.

It is a more particular object to create a self-contained unit that can be easily and reliably installed by hospital personnel with only a minimum of special training and without need for special tools.

In one aspect of the invention, the hospital environmental control unit of the present invention could employ the existing HEPAir cabinet design and organize the internal components in a way that allows it to perform the operations needed in this application. The evaporator fan or room air fan (or blower) draws return air from the room, through a pre-filter, then past a UV lamp or battery of UV lamps, then through a HEPA filter and the cooling or evaporator coil. A supplemental heating coil may be used for warming the air. Then the treated, filtered air is supplied to the hospital room, fully conditioned and filtered. Particles in the air are subjected to the killing effect of the UV light as they pass through the W illuminated zone, and are further exposed when captured on the HEPA filter. The heating and cooling coils work to control the patient room at the desired temperature. The separate condenser fan draws air from outside or from the building system through the condenser coil by means of flexible ductwork. The condenser air picks up the waste heat from the unit, and then the air is discharged into the outside air or else into the building HVAC system. If outside air is used, the building air conditioning system must be sealed off. If the building system is used, it will effectively be isolated from the room and only used as condenser air plus makeup air.

According to one aspect of the present invention, an air passage or air plenum is added to provide a controllable passageway which allows fresh air to be drawn into the evaporator system to positively pressurize the room, or to draw off some of the conditioned air from downstream of the evaporator fan to negatively pressurize the room. Since the make-up air enters upstream of the UV tubes and upstream of the HEPA filter, it is treated before it enters the room so as to protect the patient. The amount of this fresh air is controlled by adjusting a slide damper inside the cabinet. If the slide damper is moved to another position, the damper closes the fresh air passageway to the evaporator return plenum, and opens a passageway from the supply plenum to the condenser air plenum. In this position the room can be negatively pressurized. A portion of the supply air, which has been treated by the UV tubes and the HEPA filter, is drawn into the condenser air flow, and the condenser fan exhausts it outside the room, either to the outside air or into the building HVAC system with the rest of the condenser air. The air evacuated from the room is UV treated and filtered, which protects persons outside from contamination or contagion.

According to another aspect of this invention, an air conditioner and filtering unit is provided for creating a positive pressure, negative pressure, or neutral pressure in a hospital room or other conditioned space. Inside a housing for the unit, a refrigeration circuit has a compressor, a condenser coil, and an evaporator coil. A common air intake plenum has a first return air inlet for admitting return air from the conditioned space into the common plenum, a second return air inlet for admitting outside air into the plenum, and a supply duct connecting the second return air inlet to an air source outside the conditioned space. A supply air outlet exhausts cleaned and conditioned air into the conditioned space. An exhaust air duct exhausts condenser air, also cleaned, to an outlet outside the conditioned space; an inside airpath, i.e., evaporator airpath within the housing leads from the common intake plenum to the supply outlet, the inside air path including a HEPA filter arrangement, and in many cases a UV sterilizer, for cleaning the air in the inside air path, the evaporator coil, and an evaporator fan for drawing the air through said HEPA filter arrangement and said evaporator coil. The evaporator fan then exhausts the cleaned and conditioned air through the supply air outlet into the conditioned space. A condenser air path leads from the common intake plenum to the exhaust air duct. The condenser air path includes a HEPA filter arrangement for cleaning the air in the condenser air pathway, the condenser coil, and a condenser fan for drawing the condenser air through the HEPA filter arrangement and through the condenser coil. The consenser fan then exhaust the condenser air outside the conditioned space as cleaned air. A slide damper or other suitable means to open or close the intake ports or vents can be employed selectively opening and closing air flow through the first and second return air inlets into the common intake plenum to create selectively an overpressure, an underpressure, or neutral pressure in the conditioned space.

Important features of the units of this system which permit them to function in this application are high volume and high static pressure fans; two completely separate fans, one for the evaporator and one for the condenser; relatively small size and portability of the units (e.g., mounted on wheels), and requiring only application of standard 115 v single-phase AC electric power and light-weight flexible ducts for the condenser air; corrosion-free all-aluminum or plastic cabinet construction; completely self-contained system, with heating and air conditioning, UV sterilization, HEPA filtration, and positive and negative pressurization, all contained in the housing. Some optional equipment features include humidity control (humidifier) and flexible duct kits for the supply and return room air.

These units, which may be referred to as hospital environmental control units have a net cooling capacity of e.g., 5000 BTU/H and a 1000 W heater. The dimensions are favorably 18 inches wide, 30 inches deep, and 48 inches high. The unit is provided with wheels for mobility, and weights about 150 pounds. The unit is provided with a six foot 115 v power cord, and draws about 15 amperes. Flexible ducts eight to ten inches in diameter are employed to connect the condenser inlet and outlet with the building system, or to reach the outside air via a window.

In one embodiment, a slide baffle controls the communication of air between the return plenum or the supply plenum and the pressurization control plenum, which in turn communicates with the condenser air pathway. The slide baffle can be moved to positions for positive pressure, negative pressure, or neutral. This can be done by hand, or by means of a linear motor. Openings on the slide baffle line up with vent openings on the side of the return plenum and the supply plenum, depending on whether positive or negative pressure is needed. These can be partially or fully aligned, so that the amount of pressurization can be controlled.

In another embodiment, the slide baffle can control the air flow into the common intake plenum from a first (room-air) inlet and a second (outside-air) inlet, which may be connected via a duct to the supply ducting of the building air conditioning. By moving the slide, one inlet or the other is opened, and the other closed, and this controls whether the room has a net positive pressure or net negative pressure. It is possible to move the slide baffle to a mid-way or neutral position so that both are partly open, which can be used to create a neutral room pressure.

The above and many other objects, features, and advantages of this invention will become apparent from the ensuing description of selected preferred embodiments, which should be read in connection with the accompanying Drawing.

BRIEF DESCRIPTION OF THE DRAWING

Reference is made to the drawing Figures, in which.

DESCRIPTION OF THE PREFERRED EMBODIMENTS

Figure 1:
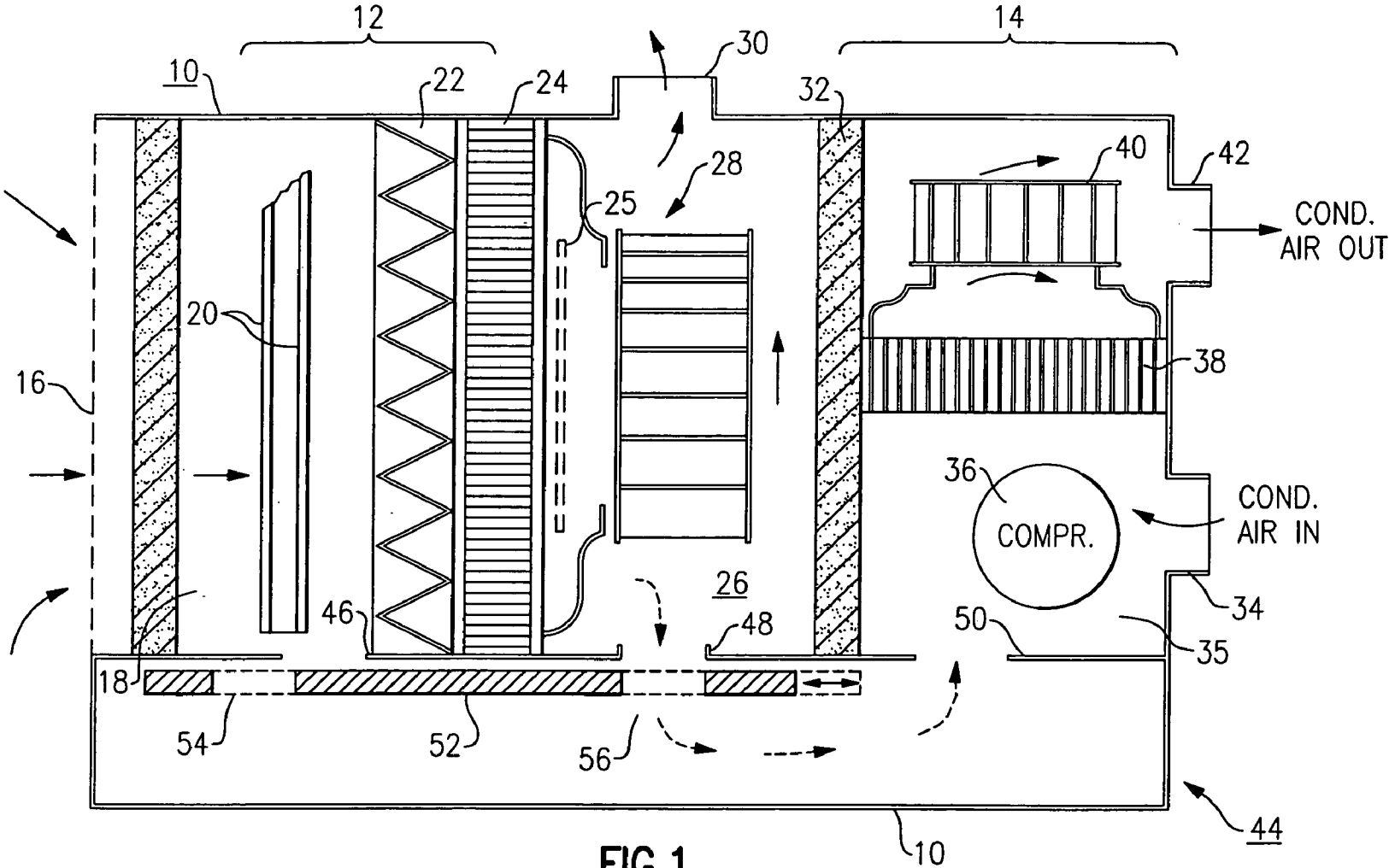
FIG. 1 is a top plan schematic view of an embodiment of the invention.
Figure 2:
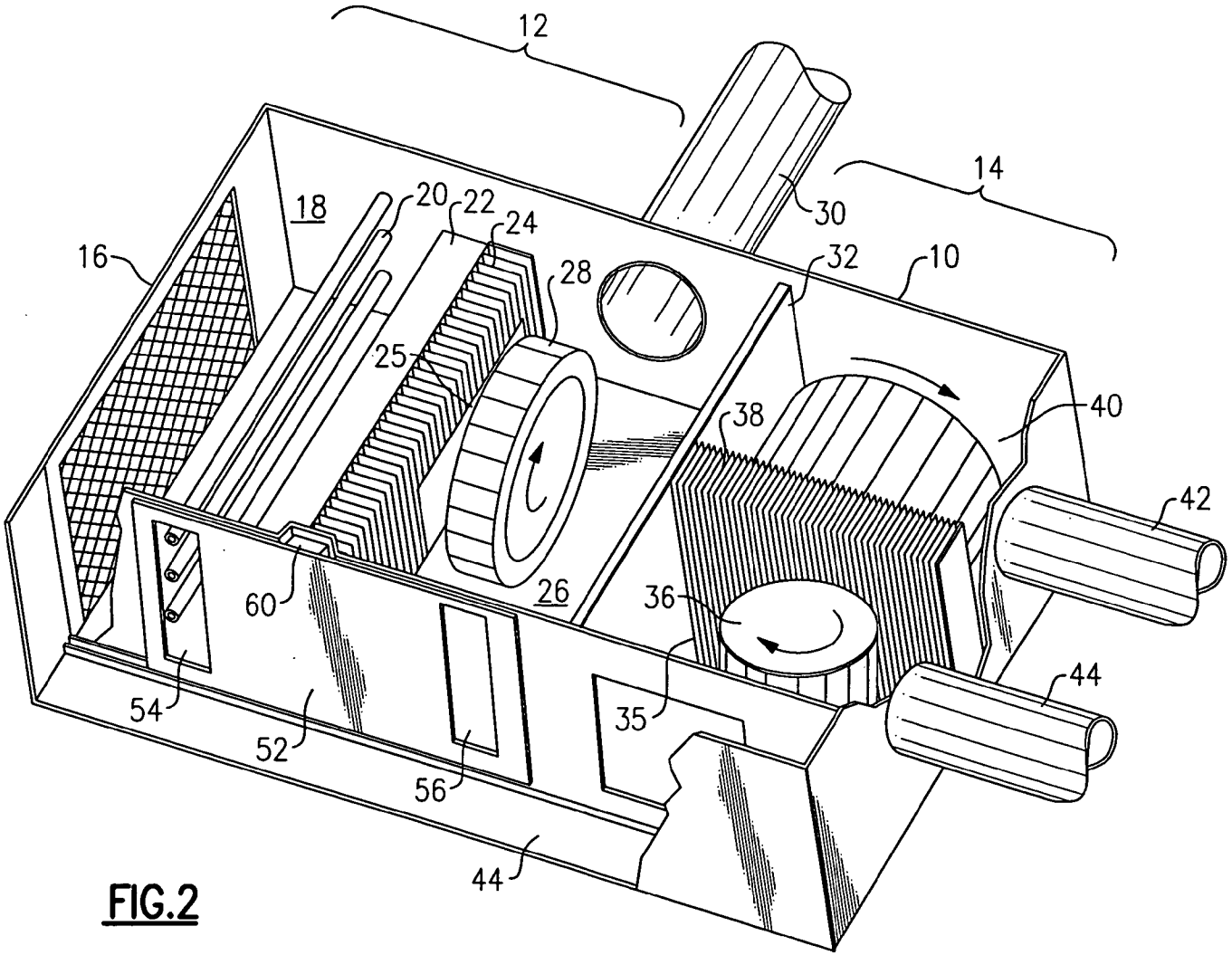
FIG. 2 is a schematic view of this embodiment, partly cut away and with some panels removed.

With reference to the drawing Figures, FIGS. 1 and 2 show the general construction of the hospital environmental control unit of one possible embodiment, with a housing or enclosure 10, and an indoor or evaporator side 12 and an outside air or condenser side 14. The indoor evaporator side 12 has an intake grille 16, which serves as inlet for return air from the conditioned room environment, and the grille may incorporate a pre-filter. This leads to a return plenum 18 in which there are UV tubes 20 that provide sterilizing ultraviolet radiation for killing airborne pathogens. After this the return air passes through a HEPA filter 22 and then through an evaporator coil 24 that chills and dehumidifies the air. An electric heat coil 25 may be present for reheating the air, as necessary to control room temperature. The UV tubes 20 also illuminate the HEPA filter 22 to kill any bacteria or other pathogens that become trapped on the filter. After this, a supply plenum 26 includes a fan or blower 28, plus associated baffles, that induce air flow through the return plenum 18, into the supply plenum 26, and then out through a supply duct 30 back to the room environment. A partition 32 separates the supply plenum from the condenser side 14 of the unit.

The condenser side 14 provides a flow of outside air (or air from the main building air conditioning system) for carrying away exhaust heat. The outside (or main building) air enters through an intake duct 34 into a condenser air inlet plenum 35. A compressor 36 is shown located here, in advance of a condenser coil 38. Other electric and refrigerant control equipment (not shown here) could be located at this plenum 35 also. After the outside air has passed through the condenser coil 38, a condenser fan or blower 40 exhausts the air through an exhaust duct 42 to the outside air (or back to the building central air conditioning system).

In this embodiment, there is a slide baffle environmental control system for controlling the relative pressurization of the conditioned space, which may for example be a hospital room or other controlled environment.

Figure 3:
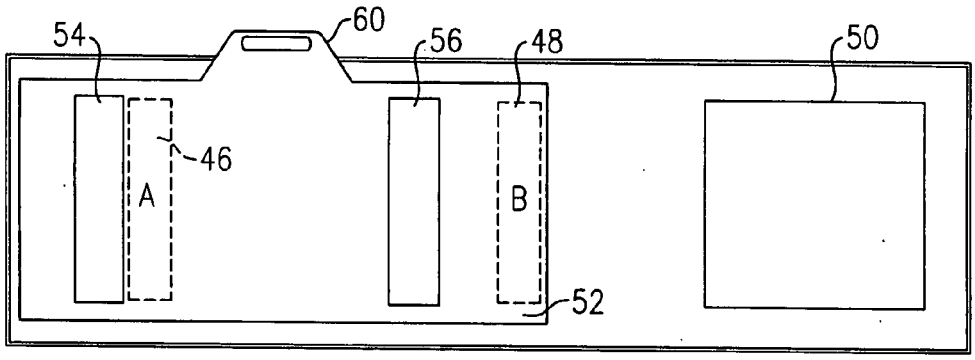
FIGS. 3, 4, and 5 are views showing the position of the slide baffle for neutral, positive pressure, and negative pressure, respectively.
Figure 4:
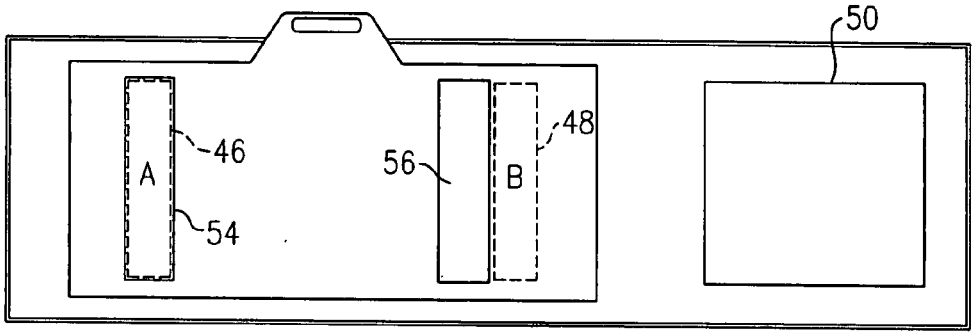
Figure 5:
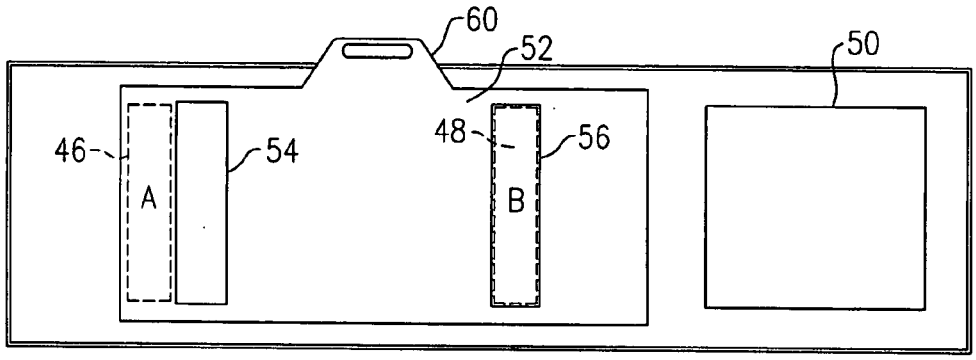

Here, an environmental pressure-control plenum or bypass plenum 44 is positioned along one side of the unit, extending along and communicating with the return plenum 18, the supply plenum 26 and the outside or condenser air inlet plenum 35. A wall of the unit has a port 46 that communicates with the return plenum 18, a port 48 that communicates with the supply plenum 26, and a port 50 that communicates with the condenser inlet plenum 35. A pressure-control slide baffle 52 is positioned alongside this internal wall, and selectively blocks or opens the supply port 48 and the return port 46. As better shown in FIGS. 3, 4, and 5, in a neutral pressure or normal position, the slide damper is positioned so that both the supply port 46 and the return port 48 are closed (FIG. 3). Because of the action of the fan or blower 28, the supply plenum 26 air is above ambient pressure, and the return plenum 18 air is below ambient pressure. The slide baffle 52 can be moved to a positive pressure position, shown in FIG. 4, in which the return port 46 is aligned with a control opening 54 of the slide baffle, so that some outside air will be drawn as make-up air through the condenser side port 50 and the bypass plenum 44 and port 46 into the return plenum of the unit. For negative pressurization, the slide baffle 52 can be moved to a position as shown in FIG. 5 in which the supply port 48 is aligned with another control port 56 on the slide baffle, and there is some exhaust air flow from the supply plenum 26, through the port 48 and the bypass plenum 44 to the condenser air port 50 where a portion of the room air is exhausted from the conditioned space. The two control openings 54 and 56 of the slide baffle 52 are positioned so that the return and supply ports 46, 48 cannot both be opened at the same time into the control plenum 44. As also shown in these views, there may be a handle 60 at a top side of the slide baffle 52 so that a hospital worker can easily move the slide baffle to the desired position.

Figure 6:
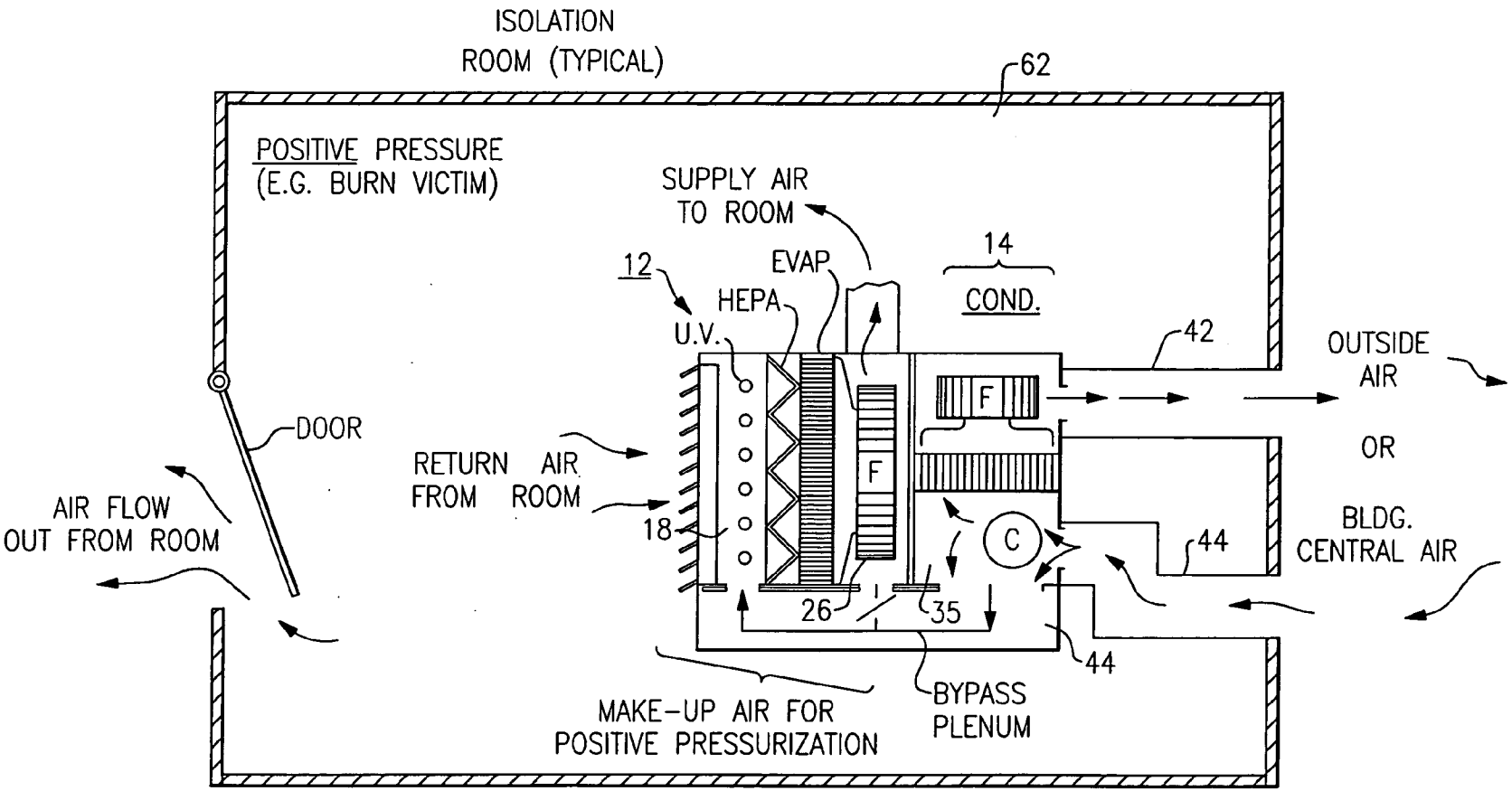
FIGS. 6 and 7 are schematic views showing the unit of this invention employed in a hospital room to create an isolation area, with positive pressurization and negative pressurization, respectively.

FIG. 6 schematically shows one practical application of the hospital environmental control unit of this invention, here arranged to create a positive pressure or overpressure in a normal or typical hospital room 62. This permits the room to be made into an isolation room for a burn victim or other hospital patient that must be protected from infection from airborne pathogens that may be present in the air outside the patient's room. The slide baffle is in the positive pressure position, so that there is air flow from the condenser side 14, through the bypass plenum 44, into the return plenum 18. The flow into or from the supply plenum 26 is blocked. This means that a portion of the outside air or main building conditioned air will constitute make-up air. The room air is positively pressurized, so that any air flow is in the direction out of the room. It should be noted that all the make-up air as well as all the return air from the room that enters the return plenum 18 will flow past the UV tubes 20 and through the HEPA filter 22 so that the airborne pathogens are removed and destroyed.

Figure 7:
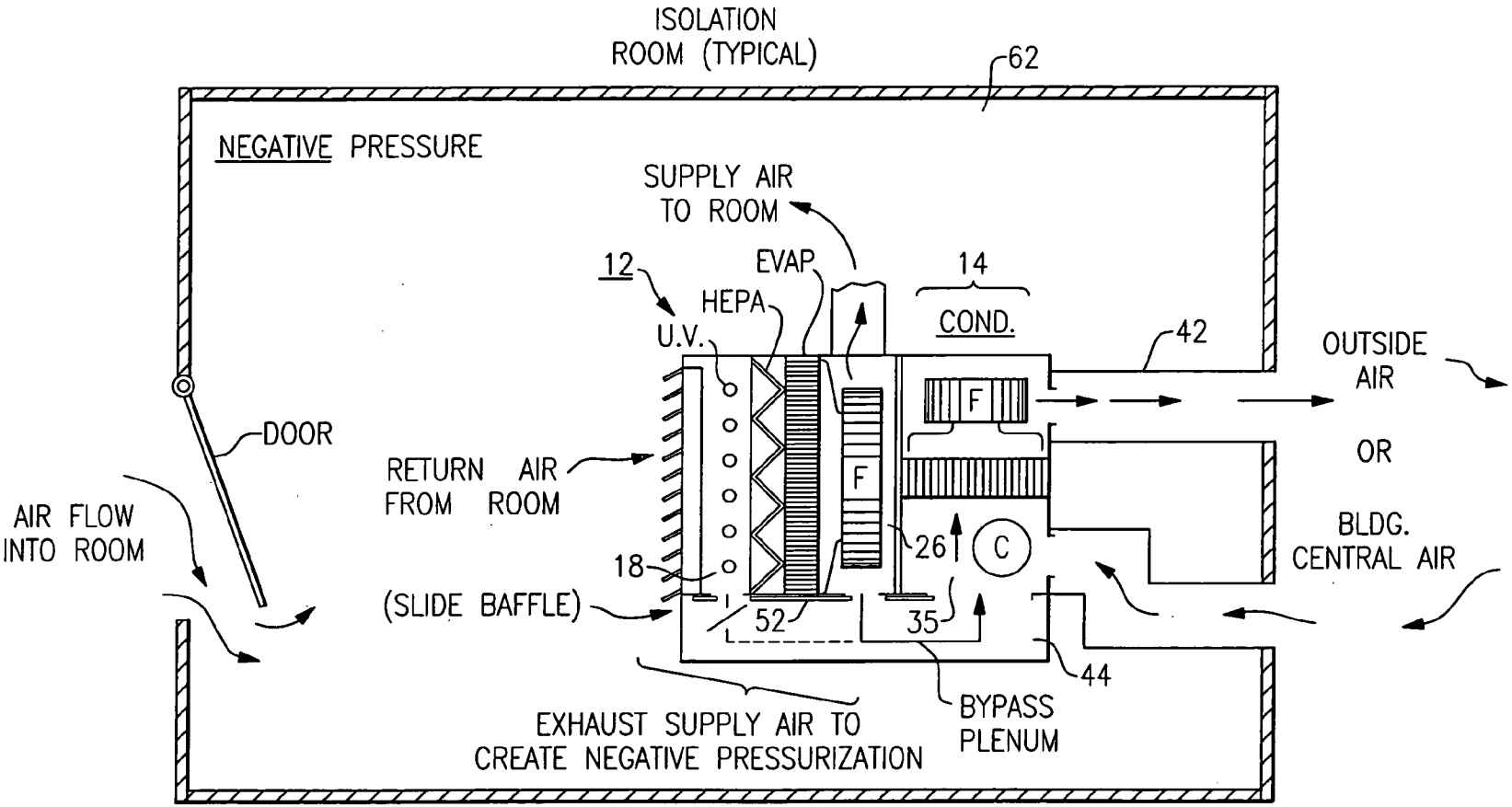

FIG. 7 schematically shows the unit arranged to create a negative pressure or underpressure in the same hospital room 62, here creating an isolation room in which a patient who carries an infectious disease, for example, may be maintained in isolation and the rest of the hospital environment may be protected from contamination. In this case, the slide baffle is placed in the negative pressure position, so that a portion of the indoor air flows out from the supply plenum 26, into the bypass plenum 44, and then into the condenser side 14 where that air is exhausted with the condenser air into the outside air or into the building central air. Air flow from the bypass plenum 44 into the return plenum 18 is blocked. As shown here, with the room kept at a relative negative pressurization, any flow of air is in the direction into the room, keeping contaminants inside the room. It should also be noted, that all air in the supply plenum 26 will have flowed past the UV lamps 20 and HEPA filter 22, and is free of airborne pathogens, so only clean air is exhausted from the isolation space into the outside air or into the hospital central air system.

In some cases, the position of the baffle may be placed at a partway position, so that the port 46 and baffle opening 54 or the port 48 and baffle opening 56 are partly aligned. This enables the unit to create a controlled level of underpressure or overpressure, if that is needed. Also, the shapes of the ports and openings are not limited to the vertical rectangular shapes illustrated here.

Figure 8:
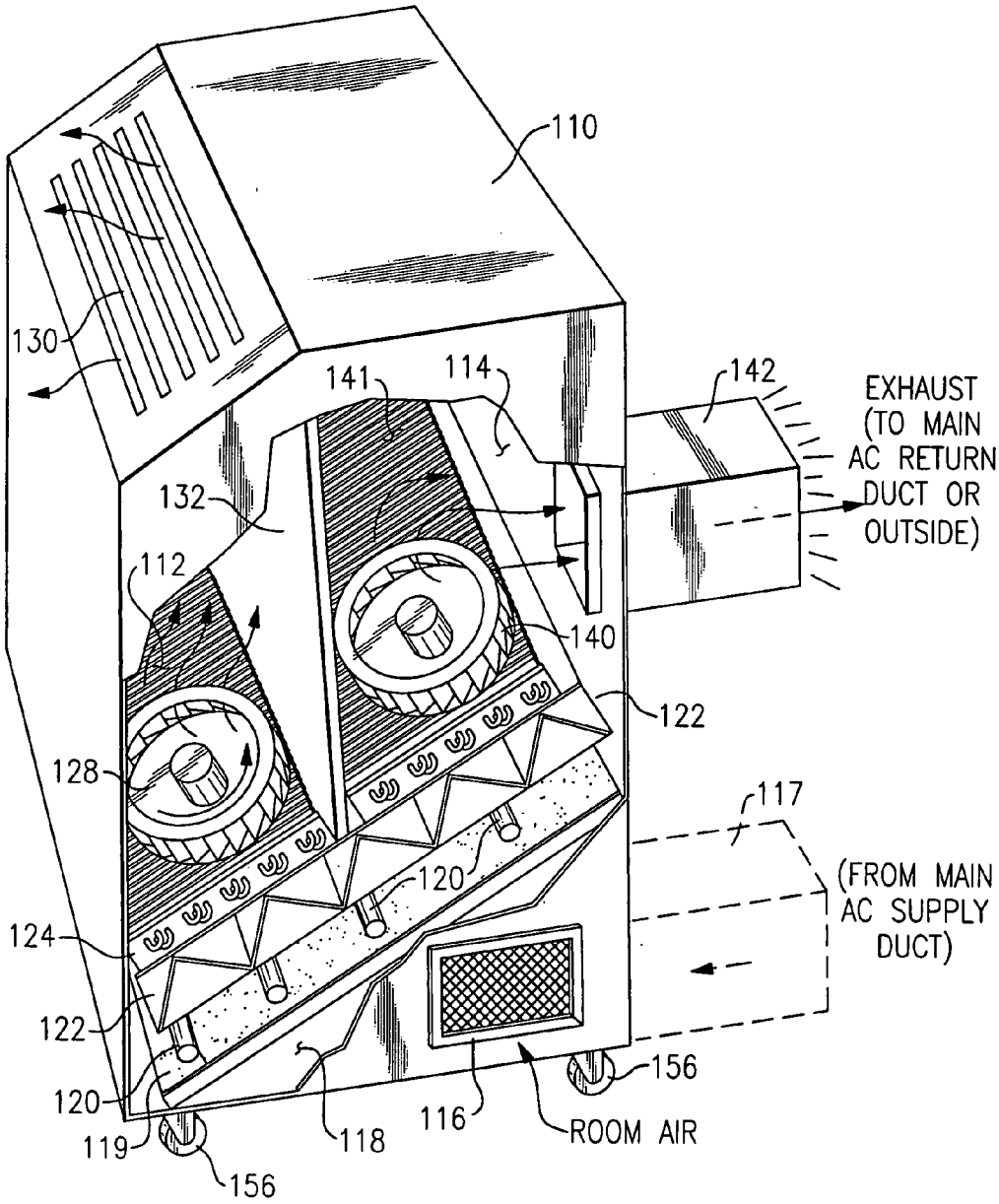
FIG. 8 is a perspective view showing another embodiment.
Figure 9:
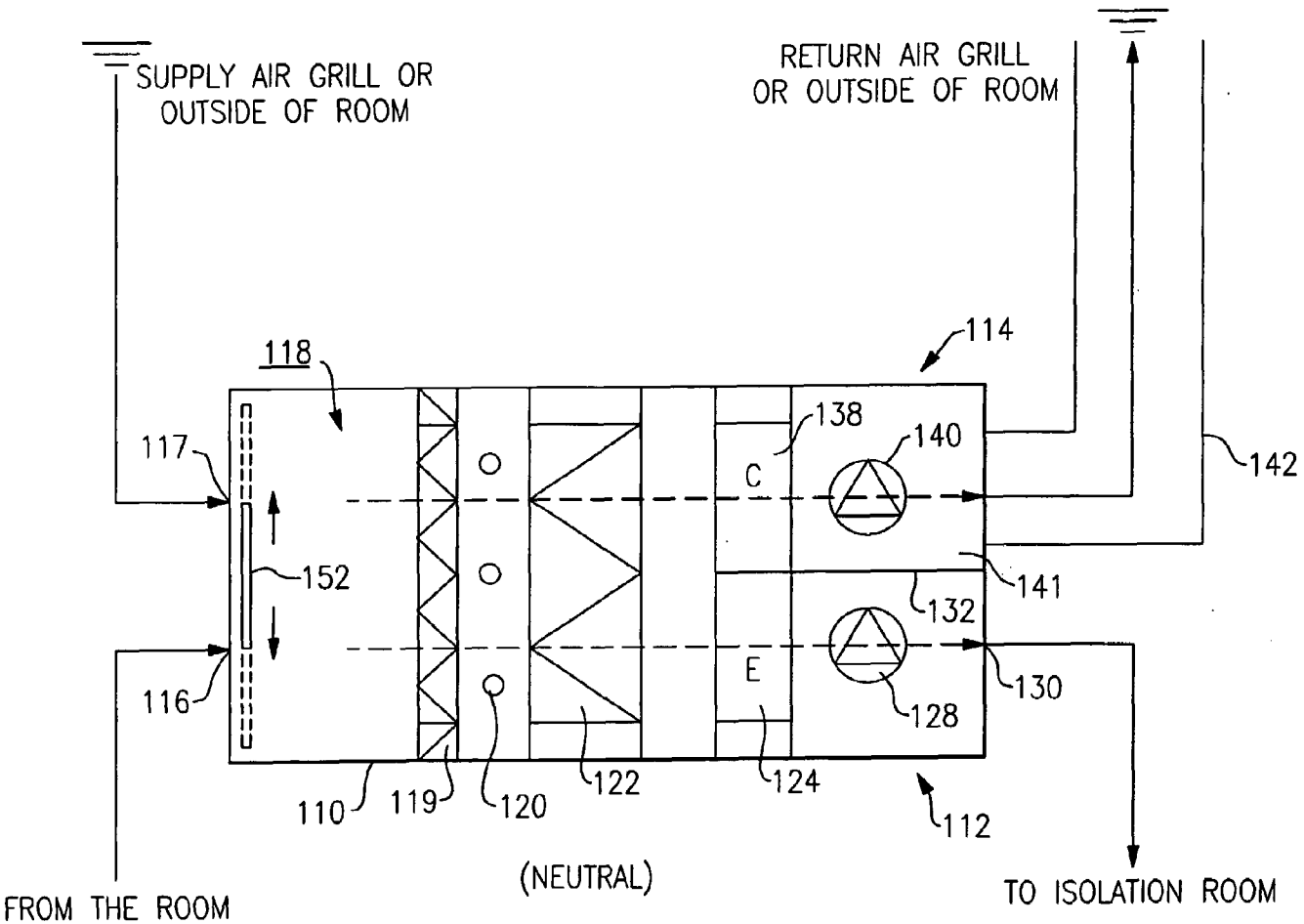
FIGS. 9, 10, and 11 are schematic views of this embodiment for explaining its operation.
Figure 10:
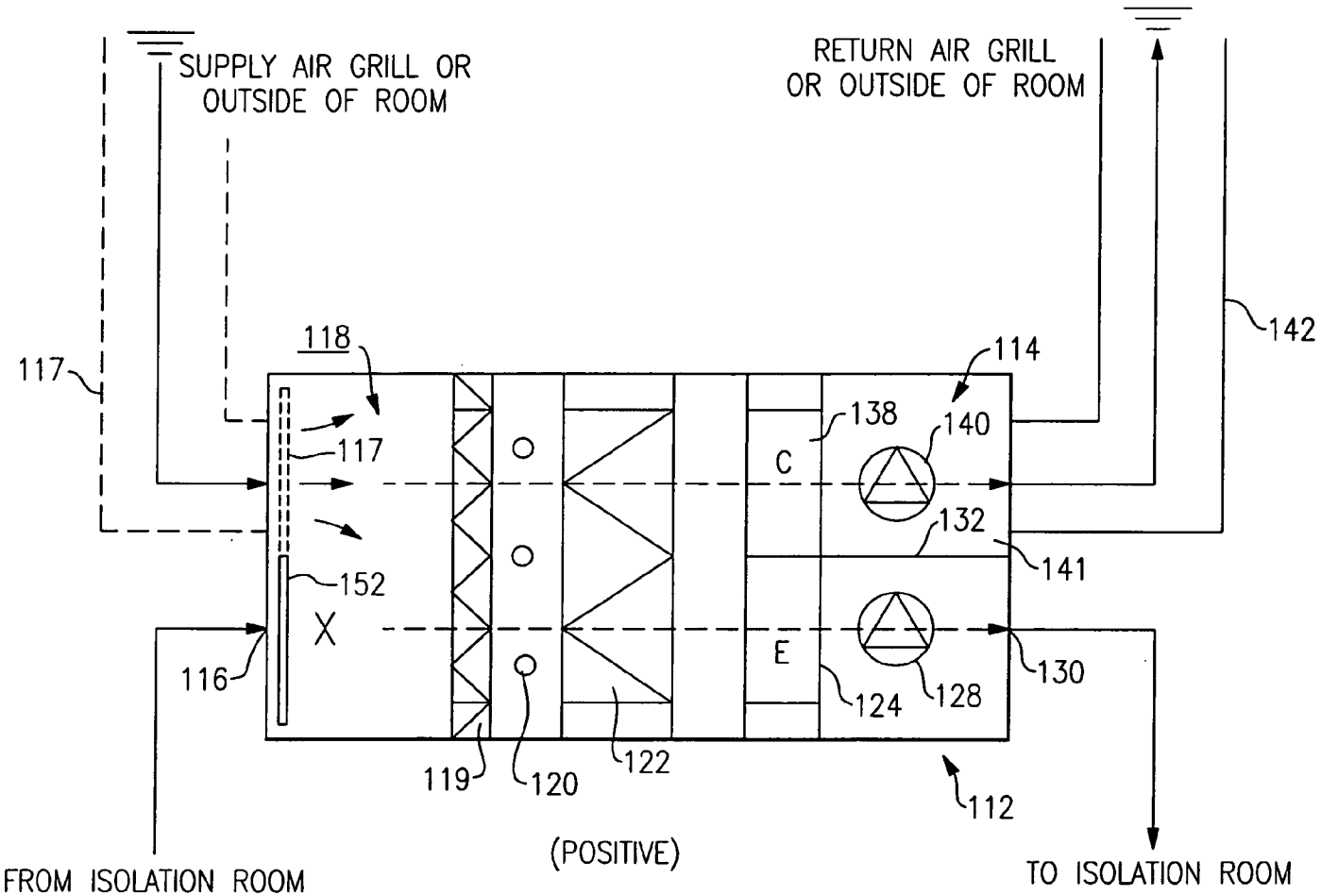
Figure 11:
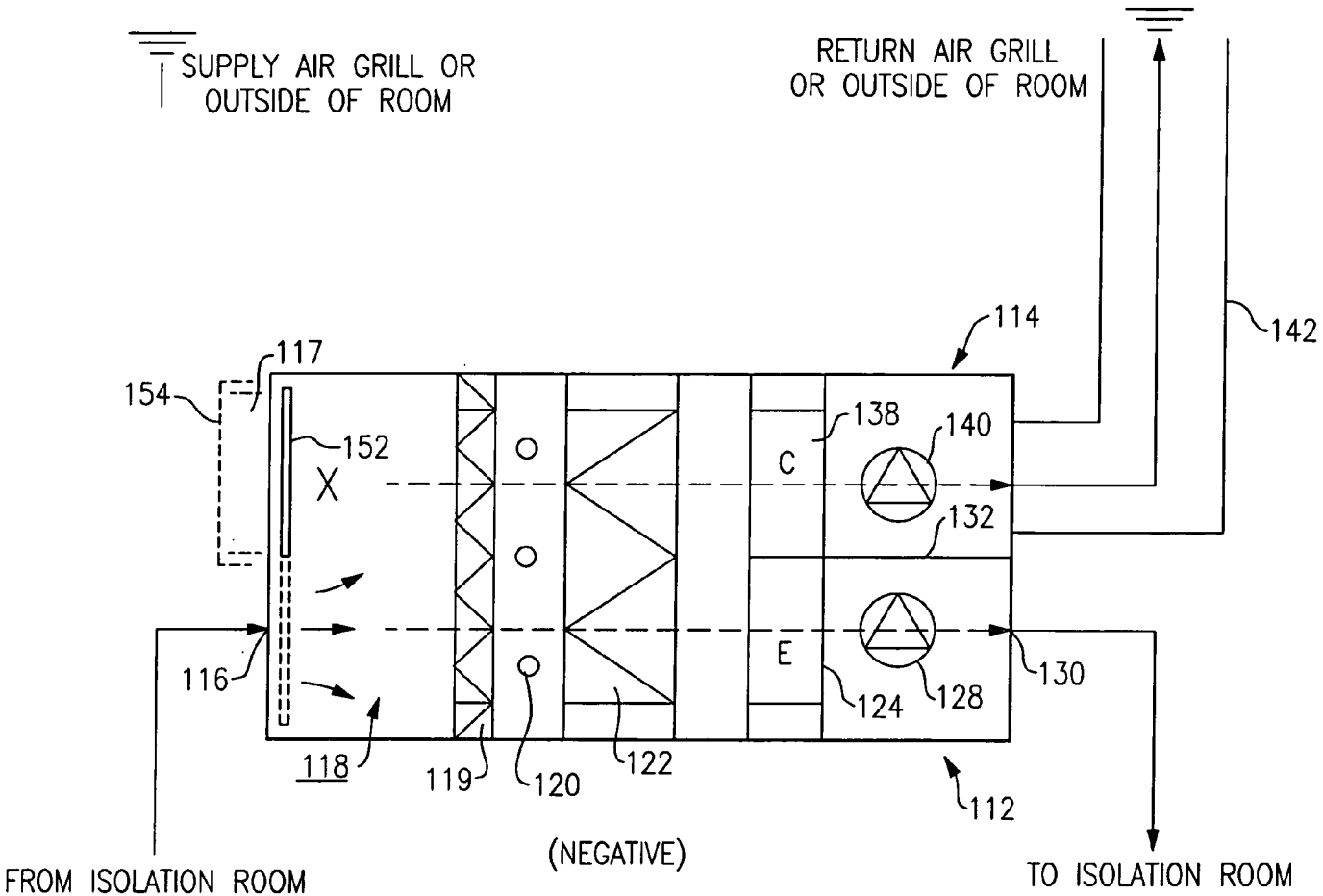

Another possible embodiment of this invention is shown in perspective in FIG. 8, and schematically in FIGS. 9, 10, and 11. Here, elements that correspond to similar elements in the first embodiment are identified by similar reference numbers but raised by 100.

This embodiment is a self-contained unit in which the room air and air from the main air conditioning system are fed into a common intake plenum, and all of that air is cleaned and filtered. Then the air is fed from that through both an evaporator side, in which the air is conditioned and returned to the room and through a condenser side, in which the air picks up waste heat and is exhausted as cleaned, filtered air into the return ductwork of the building air conditioning system. The relative amounts of room air and of A/C system supply air that is fed into the common intake plenum determines the room pressure relative to the ambient pressure outside the room. If room air only is used for both the condenser side air and the evaporator side air flows, then a negative room pressure will result, which means there will be a net leakage into the room and there will be no contaminated air leaking out of the room. If building AC supply air only is used for both the condenser side and the evaporator side air flows, then there will be a net positive pressure, so all leakage will be out from the room, and there will be no potentially contaminated air leaking into the room from the outside environment. The relative amounts of room air and building AC air into the common intake plenum can be adjusted, if desired, to produce a desired positive or negative room pressure or a neutral pressure.

In some possible applications, outside non-conditioned air can be used instead of building AC supply and return air. However, the use of building AC system air can relieve some of the cooling load that the unit would otherwise have to bear, and this allows the compressor and coils to be of a smaller capacity with smaller electrical load requirements. Also, this permits the unit to be used in rooms or spaces that may not have access to outside air.

As shown in FIG. 8, one possible embodiment of the hospital environmental control unit of this invention has a housing or enclosure 110, which is illustrated here partly cut away to reveal an evaporator side or pathway 112 (in the front) and a condenser side or pathway 114 (in the rear). At the base there is a room air intake vent 116 and an outside air intake duct 117 which both connect with a common air intake plenum 118 in the lower part of the unit. The duct 117 is is shown in ghost here, as it may be omitted in a negative-pressure-only application. This plenum 118 is common to both the evaporator side 112 and the condenser side 114, so that air from this plenum is divided and part of the air flows through each of the evaporator pathway and the condenser pathway. Within the plenum 118 there is a pre-filter or coarse filter 119, and a bank of UV fluorescent tubes 120. Above this, i.e., downstream is a HEPA filter assembly 122 which filters microscopic contaminants, including bacteria and virus, from the air before proceeding through the evaporator and condenser pathways. This HEPA filter assembly may have a single HEPA filter or may be separate HEPA filters for the two airflow pathways.

Above the HEPA filter assembly 122 are an evaporator coil 124 and a fan or blower 128 located on the evaporator side for chilling and dehumidifying the air that is to be discharged into the patient room through a supply air grille or supply outlet 130. In this embodiment, the supply outlet 130 is located at the top of the unit.

A partition 132 rises vertically behind the evaporator coil 124 and fan 128 and divides the front or evaporator side 112 from the rear or condenser side 114. Here, there is a condenser coil 138 disposed above the HEPA filter assembly 122 and behind the evaporator coil 124, and a condenser air fan 120 that draws the air through the HEPA filter assembly and through the condenser coil 138 into a condenser air plenum 141 that is located behind the partition 132. An exhaust air duct or conduit 142 connects the condenser air plenum 141 with a means for accepting the discharged condenser air. In this embodiment, the duct 142 connects to the building air conditioning system return air ductwork, but in other embodiments it could connect with a general air discharge ducting, or could simply be exhausted to the outdoor air.

While not specifically shown here, the unit would also include a refrigerant compressor, which could be located at a convenient place within the cabinet 110. An electric heating element in the evaporator side could be used as necessary to preheat air being returned to the hospital room. Other controls, which are understood to be present, are omitted from this illustration.

The unit of this embodiment is shown schematically in FIGS. 9, 10, and 11. There a slide damper 152 is shown with one position across the outside air intake 117 and another across the room air intake 116, and is moved to an appropriate position to control the amount of air being drawn into the intake plenum 118. As shown here, the sterilized and filtered air having passed through the UV tube bank 120 and HEPA filter assembly 122 splits and passes through each of the condenser side (from which it is exhausted from the conditioned space) and through the evaporator side (from which it is discharged back into the conditioned space). The exhaust air duct 142 is always connected between the condenser air plenum 141 and the outside of the conditioned space (e.g., the building A/C return ductwork). The pressure within the room can thus be controlled by adjusting the position of the slide damper 152.

FIG. 10 illustrates a net over-pressure setting, in which the slide damper is moved to block the air flow from the conditioned space into the common plenum 118, so that all the air is supplied from a source outside the room, e.g., from the building A/C supply ducting. The airflow from the outside source then flows through both the evaporator and condenser sides 112, 114, such that part of the air flow is exhausted into the room as cleaned and sanitized conditioned air, and part is exhausted outside the room together with the waste heat from the condenser coil 138, as cleaned and sanitized exhaust air. In this condition, the air pressure in the room is higher than in the general building environment, and the direction of air leakage is from inside the room to outside the room. This setting would be used for patients that must be protected from contamination from outside the room.

FIG. 11 illustrates a net under-pressure setting, in which the slide damper 152 is moved to permit air flow from the conditioned space into the common plenum 118 but block the air flow from outside the conditioned space (such as through the duct 117). Again, part of the air flow passes through the evaporator side 112 and part through the condenser side 114, so that part of the air is returned to the room as cleaned, sanitized conditioned air, and part is exhausted from the room, through the exhaust air duct 142, as cleaned and sanitized exhaust air. As the net air flow is out of the room, the air pressure within the room is reduced below the ambient building pressure. The negative room pressure means that any air leakage is into the room. This setting would be used for quarantining a patient with a contagious disease so that contaminants in the isolation room do not escape to other spaces within the hospital or other building.

It is also possible to set the slide damper 152 at an intermediate position (e.g., as in FIG. 9) which allows some air from outside and some air from inside the room to be admitted to the common intake plenum 118. This permits the level of underpressure or overpressure to be modulated. A neutral room air pressure can be achieved.

In the hospital environmental control units of this invention, all the air flowing through the unit is cleaned and sanitized, i.e., all the air flows past the UV tube bank 120 and all the air flows through the HEPA filter assembly 122. Consequently, all the air being returned to the room from the supply grille 130 is cleansed and sanitized, and in addition all the air flowing through the condenser coil and into the condenser plenum 141, and all the air passing in the exhaust air duct 142 is also cleansed and sanitized. This minimizes the risk of contamination of air if there is a leak in the housing 110 or in any associated ducting.

The slide damper 152 shown here is optional. The desired effect can be achieved by connecting up the outside air intake duct 117, or not, and covering or capping the room air intake 116 or the outside air intake duct opening. Otherwise, other air valving or damper arrangements can be employed to achieve modulation of air flow. A cap or closure 154 is shown in dash lines in FIG. 11, in place over the outside air intake 117. In a positive pressure configuration, the cap 154 could be used over the room air intake 116.

Also shown in FIG. 8, the enclosure 110 is mounted on wheels or casters 156 so it can be wheeled easily into the isolation room.

These and other objects, features, and advantages of this invention would be apparent to persons who work in this field. While the invention has been described with reference to preferred embodiments, many modifications and variations would present themselves to persons skilled in this art without departing from the scope and spirit of this invention, which is to be ascertained from the appended claims.

We claim:

1. A self-contained air conditioner and filtering unit for creating a positive pressure or a negative pressure in a conditioned space, comprising a housing; a refrigeration circuit comprising a compressor, a condenser coil, and an evaporator coil; a condenser side including an inlet port in said housing, an air path through said condenser coil, an exhaust outlet port in said housing, and a condenser fan forcing air through said condenser to said outlet; a conditioned air circuit including a return air intake on said housing leading into a return plenum, an air path passing through said plenum, past a HEPA filter and through said evaporator coil and a heating coil to a supply air plenum, and an evaporator fan moving said air through said evaporator coil to said plenum and out a supply duct to the conditioned space; a bypass plenum with openings communicating with the condenser side, the return plenum, and the supply plenum, and a slide baffle within said bypass plenum having first and second air openings therein in which in a neutral position, both the supply port and the return port are blocked so no air flows between the supply or return plenums and the bypass plenum, in a positive pressure position, the return port is opened but the supply port is blocked, and in a negative pressure position, the supply port is opened but the return port is blocked.

2. The self-contained air conditioner and filtering unit of claim 1, wherein said conditioned space is situated in a building having an air conditioning system having a conditioned air supply port feeding conditioned air into the space and an air conditioning return port into which the air in the space is exhausted; and wherein said condenser side inlet port is connected to the conditioned air supply port and the condenser side exhaust outlet port is connected to the air conditioning return port.

3. The self-contained air conditioner and filtering unit of claim 1, wherein said conditioned air circuit also includes a UV sterilizer arrangement in advance of said HEPA filter.

4. A self-contained, portable air conditioner and filtering unit for creating a positive pressure, negative pressure, or neutral pressure in a conditioned space; comprising a housing, a refrigeration circuit including a compressor, a condenser coil, and an evaporator coil; a common air intake plenum having a first return air inlet for admitting return air from the conditioned space into the plenum, a second return air inlet for admitting outside air into the plenum, and a supply duct connecting the second return air inlet to an air source outside the conditioned space; a supply air outlet for exhausting cleaned and conditioned air into the conditioned space; an exhaust air duct for exhausting condenser air to an outlet outside the conditioned space; an inside airpath within the housing and leading from said common intake plenum to said supply outlet, the inside air path including HEPA filter means for cleaning the air in the inside air path, said evaporator coil, and an evaporator fan for drawing the air through said HEPA filter means and said evaporator coil and for exhausting the cleaned and conditioned air through said supply air outlet into said conditioned space; a condenser air path leading from said common intake plenum to said second exhaust air duct, the condenser air path including HEPA filter means for cleaning the air in the condenser air path, said condenser coil, and a condenser fan for drawing the condenser air through the HEPA filter means of the condenser air path, and through the condenser coil, and forcing the condenser air into said exhaust air duct for conducting the condenser air outside the conditioned space; and means for selectively opening and closing air flow through the first and second return air inlets into the common intake plenum to create selectively an overpressure or an underpressure in the conditioned space.

5. An air conditioner and filtering unit according to claim 4, wherein said conditioned space is situated in a building having an air conditioning system having a conditioned air supply port feeding conditioned air into the space and an air conditioning return port into which the air in the space is exhausted; and wherein said supply duct is connected to the conditioned air supply port and said exhaust air duct is connected to the air conditioning return port.

6. An air conditioner and filtering unit according to claim 4, further comprising prefilter means and UV sterilization means situated in said common intake plenum in advance of said HEPA filter means.

7. An air conditioner and filtering unit according to claim 4, wherein said means for selectively opening and closing air flow includes a slide damper that can be moved to open either one of said first and second return air inlets and to block the other.

8. An air conditioner and filtering unit according to claim 7, wherein said slide damper is movable into a neutral position in which both the first and second return air inlets are partly opened.

9. An air conditioner and filtering unit according to claim 4, wherein said means for selectively opening and closing air flow includes a cap for selectively covering one or the other of the first return air inlet and the second return air inlet.

10. An air conditioner and filtering unit according to claim 9, wherein said supply duct is disconnected from said second return air inlet when said cap is applied thereto.

* * * * *